US005493171A

United States Patent [19]

Wood, III et al.

[11] Patent Number: 5,493,171

[45] Date of Patent: Feb. 20, 1996

[54] SPARK PLUG HAVING TITANIUM DIBORIDE ELECTRODES

[75] Inventors: Charles D. Wood, III; James Lankford, Jr.; Cheryl R. Blanchard; James J. Cole, all of San Antonio; Gerald S. McAlwee, Austin, all of Tex.

[73] Assignee: Southwest Research Institute, San Antonio, Tex.

[21] Appl. No.: 321,037

[22] Filed: Oct. 5, 1994

[51] Int. Cl.[6] ..... H01T 13/39

[52] U.S. Cl. ..... 313/141; 313/118; 313/139; 123/169 EL

[58] Field of Search ..... 313/141, 118, 313/136, 138, 139, 140, 142, 143, 130; 123/169 EL, 169 R

[56] References Cited

U.S. PATENT DOCUMENTS

| | | | |
|---|---|---|---|
| 3,673,452 | 6/1972 | Brennen | 313/141 |
| 4,400,643 | 8/1983 | Nishio et al. | 313/11.5 |
| 4,427,915 | 1/1984 | Nishio et al. | 313/141 |
| 4,514,657 | 4/1985 | Igashira et al. | 313/130 |
| 4,742,265 | 5/1988 | Gianchino et al. | 313/141 |
| 4,743,793 | 5/1988 | Toya et al. | 313/141 |

*Primary Examiner*—Donald J. Yusko
*Assistant Examiner*—Nimesh D. Patel
*Attorney, Agent, or Firm*—Robert A. McFall

[57] ABSTRACT

A spark plug for use in an internal combustion engine comprises an electrically nonconductive body member and a pair of electrodes formed of a material each having titanium diboride as its major component. Tests indicate that titanium diboride electrodes are extremely resistant to electrical erosion. The spark plugs embodying the present invention are particularly useful in continuous cycle or heavy duty cycle engines that have heretofore been the subject of severe electrode erosion.

6 Claims, 1 Drawing Sheet

SPARK PLUG HAVING TITANIUM DIBORIDE ELECTRODES

TECHNICAL FIELD

This invention relates generally to a spark plug and more particularly to a spark plug in which the electrical discharge surface of each electrode is formed substantially of titanium diboride.

BACKGROUND ART

It has been a long term and continuously sought after goal to develop spark plugs that have longer service lives. At the present time, spark plugs have been developed for light to medium duty applications, such as in automobile engines, that have a service life of from about 30,000 to 100,000 miles. However, in heavy duty industrial applications, such as in large industrial engines often operating on natural or unrefined fuels at well heads or other remote locations, a typical service life for spark plugs, even with platinum or rubidium electrodes, is on the order of 1,500 to 2,500 hours of operation. Not only are the spark plugs for such engines initially costly, but they are often difficult to access and require that the engines be shut down several hours for cooling prior to removing old plugs and installing the new ones. Thus, changing spark plugs in these situations is not simply a matter of inconvenience, but one with significant economic disadvantages One recent example of an attempt to improve the service life of spark plugs is disclosed in U.S. Pat. No. 4,743,793 issued May 10, 1988 to Akihiro Toya et al. Toya forms the electrical discharge tip of the spark plug electrode by boring a hole in an electrode, filling it with noble metal particles, and then ultrasonically bonding or welding the particles in the hole. U.S. Pat. No. 4,742,265 issued May 3, 1988 to Joseph M. Giachino et al discloses a spark plug having a center electrode formed of an alloy material containing aluminum and chromium. U.S. Pat. No. 4,427,915 issued Jan. 24, 1984 to Kanemitsu Nishio et al discloses a spark plug construction in which a portion of the center electrode is formed by sintering a matrix material containing a titanium compound and an electrical conductivity-imparting substance, such as platinum, with a noble metal such as gold, silver or ruthenium.

All of the above spark plug constructions are difficult to form and contain either costly noble metals or elements such as chromium that are environmentally disadvantageous.

The present invention is directed to overcoming the problems set forth above. It is desirable to have a spark plug that has a significantly extended service life for use particularly in severe service cycle and heavy duty engine applications. Further it is desirable to have such a spark plug that does not contain costly, relatively rare, noble metal materials, or require the use of materials that are environmentally undesirable.

Importantly, it is desirable to have such a spark plug that is simple to construct and in which all of the electrode elements may be preformed prior to assembly. Moreover, the preformed electrode elements overcome the problems associated with difficult in situ processing steps such as powder compaction, sintering and subsequent shaping.

DISCLOSURE OF THE INVENTION

In accordance with one aspect of the present invention, a spark plug for use in an internal combustion engine has an electrically nonconductive body member, a first electrode that is partially enclosed in the body member with a tip portion of the electrode extending beyond the body member, and a second electrode spaced from the first electrode. Each of the electrodes have an electrical charge transfer surface that is formed of a material having titanium diboride as it major component.

Other features of the spark plug embodying the present invention include the first electrode being formed of a solid cast material in which titanium diboride is the major component of the material.

In another aspect of the present invention, the second electrode is a monolithic structure formed of a material having titanium diboride as it major component and is partially enclosed within the body member.

BEST MODE FOR CARRYING OUT THE INVENTION

Figure 1:
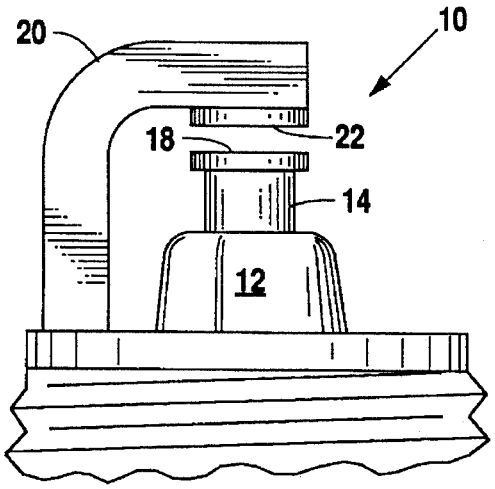
FIG. 1 is a partial sectional view of the electrode end of a spark plug embodying the present invention.

A spark plug 10 for use in an internal combustion engine includes an body member 12 that is formed of a conventional electrically nonconductive material such as alumina, or similar material having an electrical resistivity sufficient to electrically insulate elements of the spark plug embedded therein. Such materials generally have an electrical resistivity of about $10^{20}$ μohm·cm.

The spark plug 10 also has a first electrode 14 that is partially disposed within the body member 12 and, in typical fashion, has a tip portion 16 extending outwardly, or beyond, the body member 12. The tip portion 16 has an electrical charge transfer surface be at its distal, or exposed, end. The first electrode 14 typically has an elongated round shape with the electrical charge transfer surface being a flat surface normal to the axis of the electrode.

The spark plug 10 also includes a second electrode 20 that is spaced from the first electrode 14 and has an electrical charge transfer surface 22 provided at a predetermined position and in a predetermined spaced, preferably directly opposed, relationship with respect to the electrical charge transfer surface 18 of the first electrode 14. The preferred arrangements for the first and second electrodes 14,20, are described below in greater detail.

Importantly, it has been discovered when one, or preferably both, of the electrical charge transfer surfaces are formed of titanium diboride ($TiB_2$) that the surfaces are not easily nor adversely affected by spark erosion. As discussed below in greater detail, a spark plug having titanium boride electrical charge transfer surfaces showed no readily observable evidence of erosion after the equivalent of 300,000 miles (483,000 km) of operation in a vehicle traveling at 60 mph (97 kph).

It should be noted that whereas the more technically accurate term "titanium diboride" is used herein to identify the material incorporated in the electrodes of the present invention, $TiB_2$ is also commonly referred to as simply "titanium boride". $TiB_2$ is a refractory material having the following properties:

| | |
|---|---|
| Melting temperature | 2980 °C. |
| Elastic Modulus | 538 GPa |
| Compressive Strength | 128 MPa |
| Hardness | 26 GPa |
| Fracture Strength | 5 MPa |
| Density | 4.48 g/cm$^3$ |
| Coefficient of Thermal Expansion | 8.6 $10^{-6}$ m/m/°K. |
| Electrical Resistivity | 7 μohm · cm |
| Oxidation Temperature | 538 °C. |

Titanium diboride is commercially available in cast rod form. One source for such rod is Ceradyne, Inc., Costa Mesa, Calif.

For test purposes, a spark plug having titanium diboride electrodes was constructed as shown in FIG. 1. The electrical charge transfer elements 18,22 of the test spark plug 10 were formed by slicing 0.1 inch (0.25 cm) "pucks" from a cast titanium diboride rod having a diameter of 0.125 inches (0.32 cm). Thus, each of the charge transfer elements 18,22 have a thickness of about 0.1 inch (0.25 cm) and a diameter of 0.125 inches (0.32 cm). The pucks 18,22 were respectively attached to the center pintle electrode (i.e., the first electrode 14) and the finger electrode (i.e., the second electrode 20) of a conventional AC non-resistor spark plug with high temperature silver solder.

The test plug 10 described above and shown in FIG. 1, was then placed in a pressure chamber in which the pressure was maintained at about 50 psig (345 kPa). The temperature and atmosphere in the chamber were both ambient, i.e., room temperature and air. The test plug 10 was sparked repeatedly for 600 hours at a frequency that produced the number of spark discharges equivalent to 6000 hours of engine operation. The voltage was maintained at a level sufficient to produce sparking but below the breakdown voltage whereat the center pintle electrode 14 arced to the surrounding insulator 12. The same test was conducted on a conventional steel electrode. As expected, the conventional spark plug had significant gap growth and severely eroded electrodes, the center pintle electrode being significantly rounded and the underside of the finger electrode acquiring a concave surface. However, quite surprisingly, the spark plug 10 having the titanium boride electrical charge transfer surfaces 18,22 embodying the present invention, had no measurable gap growth between the charge transfer surfaces and no readily observable erosion of the charge transfer surfaces.

Figure 2:
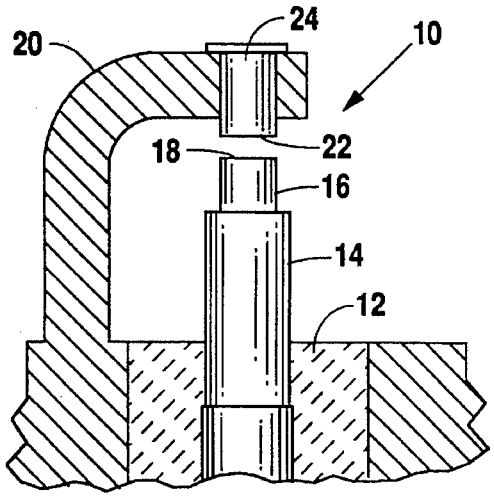
FIG. 2 is a partial sectional view of the preferred arrangement of the electrodes of the spark plug embodying the present invention.

The preferred embodiment of the present invention is shown in FIG. 2. Although suitable for test purposes, the embodiment illustrated in FIG. 1, in which the electrical discharge elements 18,22 were attached to their respective electrodes 14,20 with silver solder, is not desirable for long term, heavy duty, engine operation. Preferably, as shown in FIG. 2, both of the electrodes 14,20 are solid monolithic elements. Also preferably, both of the electrodes are formed of titanium diboride or an alloy in which titanium diboride is the primary constituent. In this arrangement, the first electrode 14 is machined from a cast rod and has a radially stepped, or reduced, tip portion 16 to reduce the area of the electrical charge transfer surface 18. The second electrode 20 has a stepped bore in which a machined electrical charge transfer surface 22 is provided at the stepped end of a solid titanium diboride element 24 inserted, preferably with an interference fit, into the stepped bore. The solid element 24 is retained in its initial position with respect to the second electrode 20 by a thin layer of braze material extending over, and circumferentially beyond, the upper end of the element 24.

Figure 3:
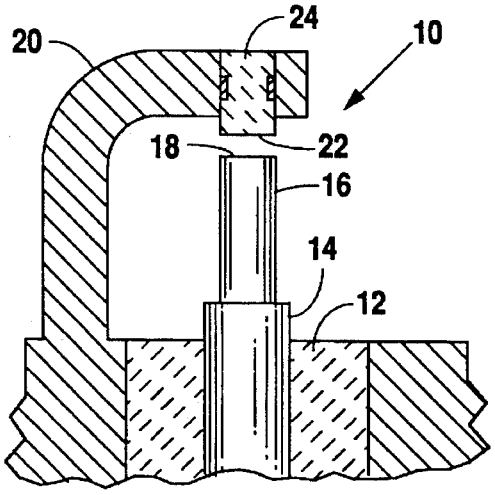
FIG. 3 is a partial sectional view of yet another arrangement of the electrodes of the spark plug embodying the present invention.

An alternative embodiment of the present invention is shown in FIG. 3. This embodiment is similar to that shown in FIG. 2 with the exception that the first, or center, electrode 14 does not have a stepped tip portion 16, and the second electrode 20 has an annular groove in which braze material is placed to maintain the solid titanium diboride element 24 in fixed position with respect to the second electrode 20.

Figure 4:
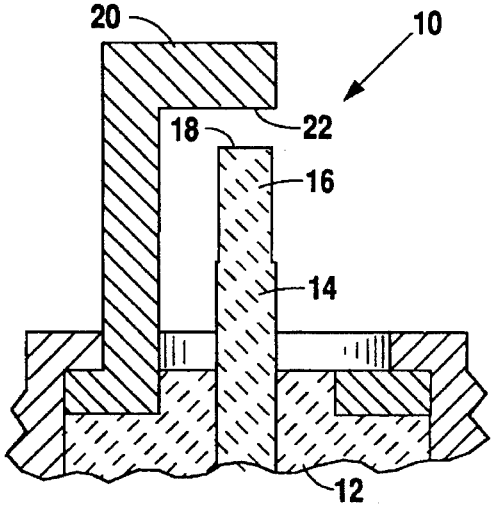
FIG. 4 is a partial sectional view of still another arrangement of the electrodes of the spark plug embodying the present invention.
Figure 5:
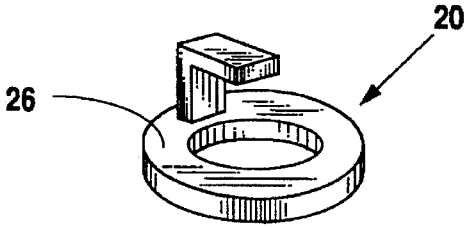
FIG. 5 is a perspective view of the one-piece second, or ground, electrode shown in FIG. 4.

In yet another alternative embodiment, shown in FIGS. 4 and 5, the second electrode 20 is desirably formed by casting and has a ring, or 'washer-shaped' base 26 that may be partially embedded in the body member 12. This arrangement enables the entire second electrode to be monolithically formed of titanium diboride.

In carrying out the present invention, it is important that at least one, and preferably both, of at least the electrical charge transfer surfaces 18,22 of the electrodes 14,20 of the spark plug 10 be formed of a material in which the primary component is titanium diboride. Preferably, the material is totally titanium diboride. However, it is recognized that small amounts of other materials, such iron or other ferrous alloys, may be added to the titanium diboride for the purpose of improving brazability or changing the electrical conductivity of the spark plug, without undesirably affecting the essential long wear, erosion resistant, properties of solid titanium diboride.

Also, although generally more costly, it is recognized that the titanium diboride electrical charge transfer surfaces 18,22 of the electrodes 14,20 may be formed by plating or coating. For example, Ion Beam Assisted Deposition (IBAD) is a process by which a dense layer of titanium diboride can be deposited to a thickness of about 40 μm on the electrodes.

Industrial Applicability

The spark plug 10 embodying the present invention is particularly useful in heavy duty cycle internal combustion engines that typically experience a high rate of erosion of the spark plug electrodes. Electrode erosion increases the gap between the charge transfer surfaces of the electrodes and, when excessive, prevents a spark from forming across the gap. Applications where electrode erosion, and consequently frequent spark plug replacement, include continuous service operations, such as engines used to operate pipeline pumps and electrical power generators. These applications are often in remote, relatively inaccessible locations and require that the engine be taken out of service for several hours when spark plug replacement is required. Such engine down time is often very costly and operationally disruptive.

Thus, as evidenced by the test described above, the extended life spark plug embodying the present invention provides significant economic and operational advantages over present spark plugs having only limited service life.

Other aspects, features and advantages of the present invention can be obtained from a study of this disclosure together with the appended claims.

What is claimed is:

1. A spark plug for an internal combustion engine, said spark plug comprising:

a body member formed of an electrically nonconductive material;

a first electrode partially disposed within said body member and having a tip portion extending outwardly from said body member, said tip portion having an electrical charge transfer surface disposed thereon;

a second electrode having an electrical charge transfer surface disposed on a predetermined portion thereof, said second electrode being spaced from said first electrode; and each of said electrical charge transfer surfaces disposed on said first and second electrodes being formed of a material having titanium diboride as its major component.

2. A spark plug, as set forth in claim 1, wherein at least one of said first and second electrodes is formed of a solid cast material having titanium diboride as its major component.

3. A spark plug, as set forth in claim 1, wherein the charge transfer surface on at least one of said first and second electrodes comprises a coating formed of titanium diboride.

4. A spark plug, as set forth in claim 1, wherein said second electrode comprises an electrically conductive support member surrounding at least a portion of said electrically nonconductive body member, and the electrical charge transfer surface of said second electrode is disposed in a predetermined opposed spaced relationship with respect to the electrical charge transfer surface on the tip portion of said first electrode.

5. A spark plug, as set forth in claim 4, wherein said second electrode has a bore formed in a portion thereof and an insert retained within said bore and having a tip portion extending outwardly from said bore in a direction toward the tip portion of said first electrode, said insert being formed substantially of titanium diboride and the tip portion of said insert having the electrical charge transfer surface area of said second electrode disposed thereon.

6. A spark plug, as set forth in claim 1, wherein said second electrode is a monolithic structure having a first portion at least partially enclosed within said body member and a second portion extending from said body member and having the electrical charge transfer surface of said second electrode disposed thereon.

* * * * *